US005842097A

United States Patent [19]

Kanbayashi et al.

[11] Patent Number: 5,842,097

[45] Date of Patent: Nov. 24, 1998

[54] IMAGE FORMING AND TRANSFERRING METHOD USING A PEELING LAYER

[75] Inventors: Makoto Kanbayashi; Ryoichi Fujita, both of Kawasaki, Japan

[73] Assignee: Canon Kabushiki Kaisha, Tokyo, Japan

[21] Appl. No.: 640,107

[22] Filed: Apr. 30, 1996

[30] Foreign Application Priority Data

May 2, 1995 [JP] Japan ..... 7-131190

[51] Int. Cl.[6] ..... G03G 13/16; G03G 15/16

[52] U.S. Cl. ..... 399/302; 399/318; 428/914; 430/126

[58] Field of Search ..... 399/297, 298, 399/302, 308, 318; 430/126; 428/914

[56] References Cited

U.S. PATENT DOCUMENTS

| | | | |
|---|---|---|---|
| 4,927,727 | 5/1990 | Rimai et al. | 430/126 X |
| 4,937,105 | 6/1990 | Sakai et al. | 430/126 X |
| 4,968,578 | 11/1990 | Light et al. | 430/126 |
| 5,071,728 | 12/1991 | Watts | 430/126 |
| 5,394,176 | 2/1995 | Itaya et al. | 347/128 |

FOREIGN PATENT DOCUMENTS

| | | |
|---|---|---|
| 63-166537 | 7/1988 | Japan . |
| 4-361086 | 12/1992 | Japan . |
| 8-30111 | 2/1996 | Japan . |
| 2231533 | 11/1990 | United Kingdom . |
| 2272183 | 5/1994 | United Kingdom . |
| WO9114207 | 9/1991 | WIPO . |

OTHER PUBLICATIONS

Patent Abstracts of Japan, vol. 17, No. 233 (M–1407) of May 12, 1993, with respect to JP 04–361086 of Dec. 14, 1992.

*Primary Examiner*—Fred L. Braun
*Attorney, Agent, or Firm*—Fitzpatrick, Cella, Harper & Scinto

[57] ABSTRACT

An image forming method, including the steps of: forming a toner image with a toner having toner particles and an external additive on a surface of a first image-carrying member which includes a support and a lamination layer disposed thereon containing a peeling layer, fixing the toner image on the surface of the peeling layer of the first image-carrying member to form a fixed image, peeling the peeling layer having the fixed image from the first image-carrying member, and transferring the fixed image on the peeling layer onto a second image-carrying member while swelling the peeling layer, wherein the lamination layer has at least the peeling layer and an adhesive layer, the peeling layer at least including a transfer layer and having an area expansion ratio of 102–106%. The transfer layer may preferably be a composition containing a high-saponified polyvinyl alcohol having a saponification degree of at least 90% and a low-saponified polyvinyl alcohol having a saponification degree of below 90%. The binder resin may preferably be polyester resin having an acid value of 2–25 mg KOH/g. The peeling layer having an appropriate area expansion ratio (102–106%, preferably 102–105%) is effective in allowing quick and uniform peeling thereof from the fixed image.

18 Claims, 4 Drawing Sheets

IMAGE FORMING AND TRANSFERRING METHOD USING A PEELING LAYER

FIELD OF THE INVENTION AND RELATED ART

The present invention relates to an image forming method wherein a fixed toner image formed and fixed on a first image-carrying member is transferred onto a second image-carrying member.

There has been known a method of transferring an image onto a stereoscopic matter based on transfer printing (decalcomania).

For example, there has been known a water-pressure transfer method wherein a first image-carrying member is formed by applying a water-soluble paste, such as dextrin onto a support (e.g., paper), on the resultant coated layer (film), an image is formed by using acrylic ink through screen printing and then, the image-carrying member having thereon the acrylic ink image is soaked (or immersed) in water to dissolve dextrin, and a resultant floating acrylic ink image is transferred onto a stereoscopic matter, such as pottery or earthenware, by using water-pressure.

As an electrophotographic transfer paper for use in transfer printing, there has been known "Tenpurin" (manufactured by Mutou Kogyo K.K.) which is formed by applying dextrin onto rice paper.

By using an electrophotographic apparatus, a toner image is formed on a dextrin layer surface of such a transfer paper and fixed thereon. Thereafter, an organic solvent capable of softening a resin of the fixed image is provided to the transfer paper, thus imparting an adhesive power necessary for re-transfer onto a second image-carrying member to the fixed image. After the transfer paper is intimately and oppositely attached to the second image-carrying member, the transfer paper is provide with water from the back side to dissolve the dextrin film, thus effecting transfer of the fixed image to the second image-carrying member.

In the above method, however, in case where the above transfer paper prepared by forming a water-soluble coating on an opaque (non-transparent) paper is used, it is difficult to perform registration (of position) during the re-transfer step and the transfer paper surface is softened before image formation under the influence of moisture in the ambient air. The softened dextrin is also liable to attach to a photosensitive member in the electrophotographic apparatus. Further, the transfer paper is sensitive (susceptible) to the moisture, so that the transfer paper cause large expansion and contraction (shrinkage) due to a change in moisture content. As a result, the transfer paper is liable to cause curl (curling), thus resulting in a lowered conveyability thereof in the electrophotographic apparatus.

On the other hand, there has been proposed a re-transfer material comprising polyvinyl alcohol (PVA) (partially saponified product of polyvinyl acetate) instead of dextrin, as in Japanese Laid-Open Patent Application (JP-A) H4-361086.

More specifically, the re-transfer material is formed by applying a mixture of polyvinyl alcohol (saponifiation degree=88%, "Kasesole O-5", mfd. by Nikka Kagaku K.K.) and a silicone-based anti-foaming agent onto a silicone resin layer formed on paper as a support. The re-transfer material is subjected to re-transfer process using an electrophotographic apparatus as follows. After a fixed toner image is formed on the above coat layer, the coat layer carrying the fixed toner image thereon is peeled from the support (paper) and then is oppositely applied to a re-transfer member each other, followed by application of heat and pressure to soften a resin constituting the fixed image, thus imparting an adhesiveness to the fixed image. After cooling, from the back side of the coat layer, 20%-hydrous ethyl alcohol is provided to the coat layer, whereby the adhesive power between the coat layer and the fixed image is lowered or weakened to effect re-transfer of the fixed image onto the re-transfer member.

According to this process, the coat layer carrying the fixed image is peeled from the support, whereby the coat layer per se substantially shows transparency since the coat layer principally comprises a thin film of a transparent resin (partially saponified PVA), thus facilitating positional registration.

However, the coated layer comprises the partially saponified PVA, i.e., partially saponified product of polyvinyl acetate. For this reason, similarly as in the case of "Tenpurin" as mentioned above, the coat layer (partially saponified PVA) is susceptible to moisture in the ambient air and accordingly is liable to cause curl before completion of image formation. Further, in the step of peeling the coat layer, the coat layer is partially dissolved to remain. In the electrophotographic apparatus, the coat layer is liable to be peeled from the transfer material during conveyance thereof since the silicone resin is used in a release film.

SUMMARY OF THE INVENTION

An object of the present invention is to provide an image forming method having solved the above-mentioned problems.

Another object of the present invention is to provide an image forming method capable of effecting good transfer printing (re-transfer) even in any environmental condition.

Another object of the present invention is to provide an image forming method in order to perform transfer printing using a first image-carrying member having a fixed image not readily causing curl.

Another object of the present invention is to provide an image forming method for effecting transfer printing using a first image-carrying member improved in moisture resistance and releasability or peeling exfoliation property of a peeling layer.

Another object of the present invention is to provide an image forming method for effecting transfer printing using a first image-carrying member free from or causing little contamination of a photosensitive member.

Another object of the present invention is to provide an image forming method capable of effecting a good fixation operation of a toner image and allowing good transfer (re-transfer) of a fixed toner image from a first image-carrying member to a second image-carrying member.

According to the present invention, there is provided an image forming method, comprising the steps of:

forming a toner image with a toner comprising toner particles and an external additive on a surface of a first image-carrying member comprising a support and a lamination layer disposed thereon containing a peeling layer, fixing the toner image on the surface of the peeling layer of the first image-carrying member to form a fixed image, peeling the peeling layer having the fixed image from the first image-carrying member, and transferring the fixed image on the peeling layer onto a second image-carrying member while swelling the peeling layer, wherein the lamination layer at least comprising the peeling layer and an adhesive layer, the peeling layer at least comprising a transfer layer and having an area expansion ratio of 102–106%.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
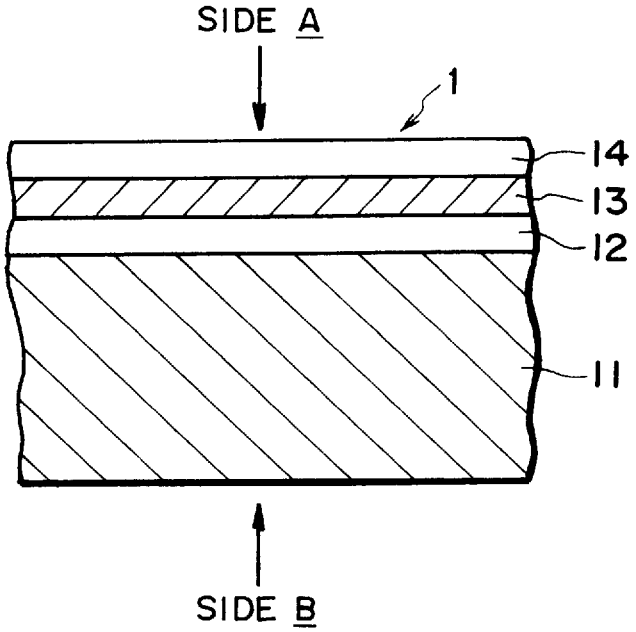
FIG. 1 is a schematic sectional view of an embodiment of a transfer sheet as a first image-carrying member used in the present invention.

The present invention is characterized by using a peeling layer having a specific area expansion ratio (102–106%) specifically defined hereinbelow.

As a result of our study, we have found that peeling of a fixed image from a peeling layer is performed quickly and uniformly by controlling an area expansion ratio of the peeling layer within a specific range in case where a fixed image once formed on a peeling layer of a first image-carrying member is fixed onto a second image-carrying member, followed by peeling of the fixed image from the peeling layer to effect (re-)transfer thereof onto the second image-carrying member.

More specifically, by controlling an area expansion ratio of the peeling layer within a range of 102–106%, preferably 102–105%, a fixed image can be well detached itself from the peeling layer at the time of swelling thereof to be transferred onto a second image-carrying member. Even if the first image-carrying member is left standing for a long period of time, the first image-carrying member is not readily curled (itself) up, thus resulting in small dimensional change.

The area expansion ratio referred to herein may be determined by measurement of an area of a sample sheet (peeling layer) in the following manner.

First, a peeling layer is peeled from a first image-carrying member and left standing for 2 days (48 hours) in a low temperature/low humidity environment (15° C., 10% RH). Then, an area ($S_L$) of the peeling layer is measured.

Thereafter, the peeling layer is left standing for 1 day (24 hours) in a high temperature/high humidity environment (30° C., 80% RH). Then, an area ($S_H$) of the peeling layer is measured.

The area expansion ratio ($S_H/S_L$ ratio) is calculated according to the following equation:

$$S_H/S_L \text{ ratio } (\%) = S_H/S_L \times 100.$$

Hereinbelow, a preferred embodiment of a first image-carrying member used in the present invention will be described with reference to FIG. 1.

FIG. 1 shows a schematic sectional view of a first image-carrying member 1 subjected to image forming method (transfer printing) according to the present invention.

Figure 2:
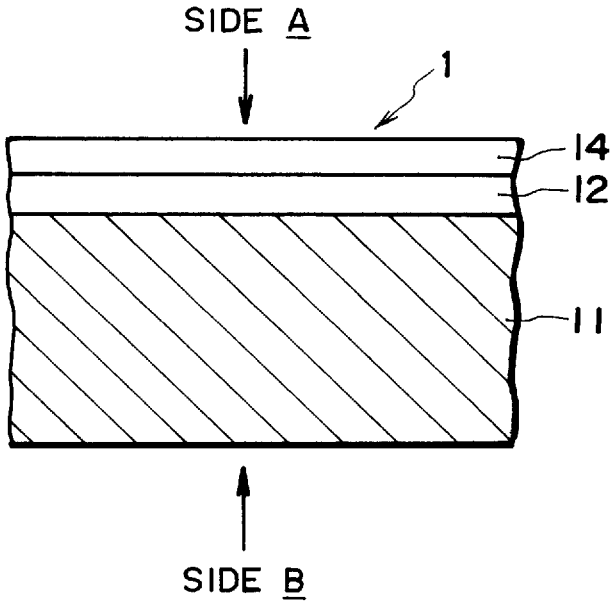
FIG. 2 is a schematic sectional view of another embodiment of a transfer sheet as a first image-carrying member used in the invention.

Referring to FIG. 1, the first image-carrying member 1 includes a support 11, an adhesive layer 12, a release layer 13, and a transfer layer 14 successively disposed in that order. The release layer 13 may be omitted as shown in FIG. 2. The release layer 13 and the transfer layer together constitute a peeling layer.

Examples of a material for the support 11 may include: plain paper free from or decreased ground wood pulp; coated paper comprising plain paper coated with a resin coating for filling or sealing up either one or both of the surfaces of plain paper; heat-resistant film, such as polyethylene terephthalate (PET). In case where the support 11 comprises plain paper, the paper may preferably have a basis weight of 30–200 g/m$^2$, more preferably 45–150 g/m$^2$. If the basis weight is below 30 g/m$^2$, a conveyance (carrying) characteristic in an electrophotographic apparatus is lowered. If the paper has a basis weight of above 200 g/m$^2$, the conveyance characteristic is also lowered because of an excessively high rigidity.

In the case of coated paper, its basis weight may preferably be 45–150 g/m$^2$. The coated paper may preferably have a volume resistivity of $10^8$–$10^{10}$ ohm.cm measured under conditions including a temperature of 20° C., a humidity of 65% RH, and a standing time of 24 hours, in order to maintain a good image transferability by the electrophotographic apparatus. The volume resistivity of the coated paper may, e.g., be readily controlled by adding thereto an inorganic salt, such as sodium chloride in an amount of 0.2–4 wt. %.

In the case of using the heat-resistant film as the support 11, the heat-resistant film may preferably comprise a biaxially stretched (heat-resistant) polyethyene terephthalate film in terms of the conveyance characteristic. The PET film (as the support 11) may preferably have a thickness of 50–200 $\mu$m, more preferably 75–150 $\mu$m. Further, the heat-resistant film (e.g., PET film) may have an antistatic layer containing a cationic or nonionic surfactant on a side B as shown in FIG. 1 so as to have a surface resistance (Rs) of $10^8$–$10^{12}$ ohm (20° C., 65% RH).

The adhesive layer 12 is formed between the support 11 and the peeling layer (constituted by the release layer 13 and the transfer layer 14) in order to prevent the peeling layer from peeling off in the electrophotographic apparatus.

Examples of a material for the adhesive layer 12 may include: resins or polymers, such as acrylic resin soluble in organic solvent, aqueous acrylic resin emulsion, water-soluble acrylic resin, water-soluble polyester, 6,6-nylon and polyacrylonitrile.

The adhesion layer 12 may further contain amorphous silicon dioxide (silica) fine powder showing an oil absorption characteristic, as desired. Such a silica fine powder has abilities of enhancing an adhesiveness to the upper release layer 13 and of absorbing moisture (water content) evaporated from an inner portion of the support 11.

The adhesive layer 12 may preferably comprise a saponified product of polyvinyl acetate, i.e., polyvinyl alcohol. Such a polyvinyl alcohol may preferably have a saponification degree (Sdeg) of at least 90%, more preferably at least 95%. In the case of using a polyvinyl alcohol having an Sdeg of below 90%, the polyvinyl alcohol may desirably contain a small amount of water-soluble silicone as a release agent (generally known as antifoamer or surfactant). If the polyvinyl alcohol has an Sdeg of below 70%, a moisture (water) resistance thereof is undesirable lowered. In case where silicone (organic silicon compound) is contained in the transfer layer 14, the transfer layer may singly function as a peeling layer as shown in FIG. 2.

The materials for the release layer 13 and the adhesive layer 12 may preferably be selected in view of adhesiveness (adhesive power) therebetween. Specifically, the above two layers 12 and 13 may preferably have an adhesive strength (A.S.) sufficient not to be peeled from each other during conveyance operations of the electrophotographic process. The adhesive strength (A.S.) between the adhesive layer 12 and the release layer 13 (or the transfer layer 14 in the case of a single peeling layer as shown in FIG. 2) may preferably be at least 1.5 g/cm (as measured by a peeling test using a peel angle of 90 degrees), more preferably 1.5–6 g/cm so as not to cause breakage of the peeling layer at the time of peeling thereof from the support 11 side.

Figure 3:
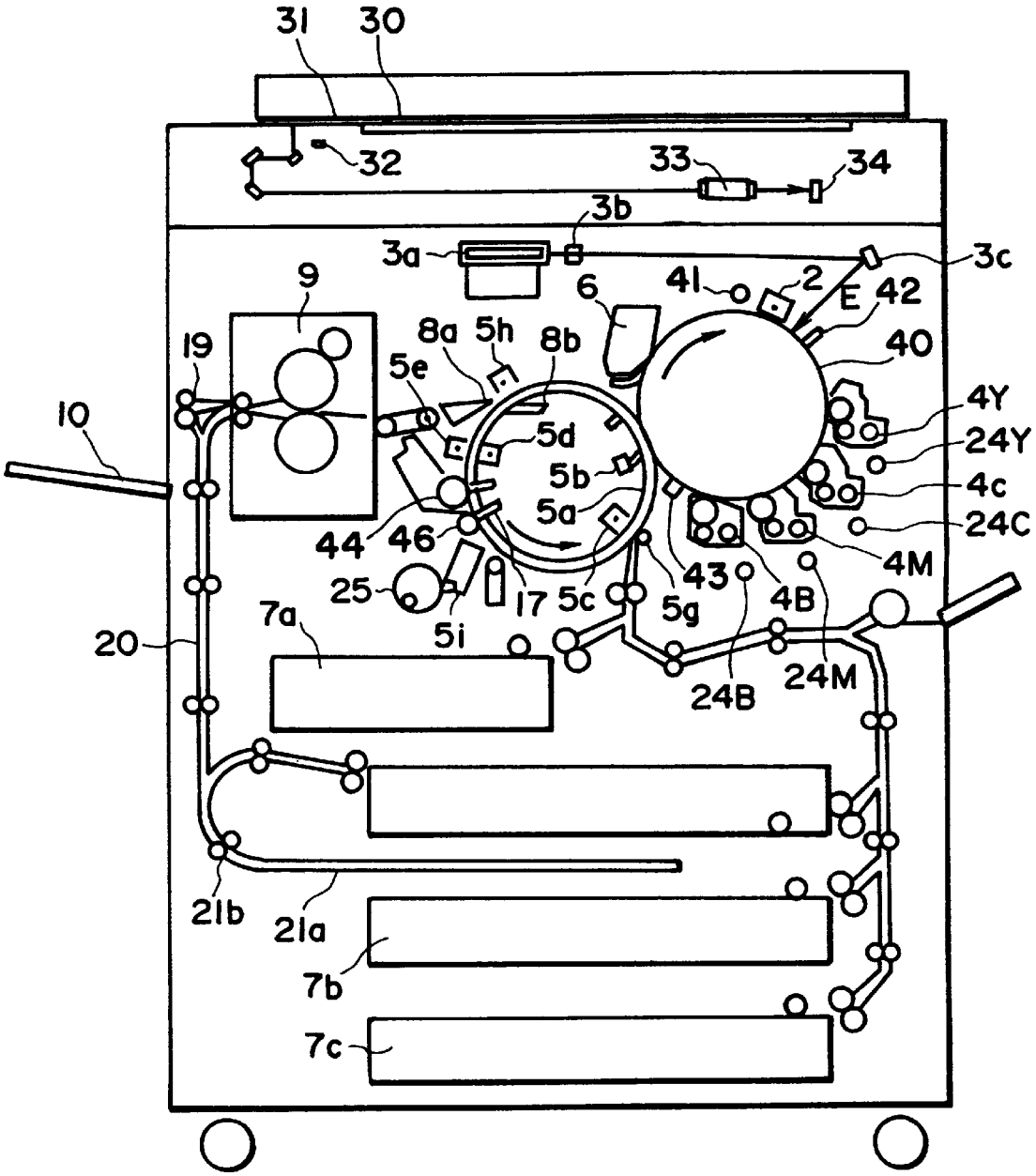
FIG. 3 is a schematic sectional view of an electrophotographic apparatus for forming a fixed image on a first image-carrying member used in the invention.
Figure 4:
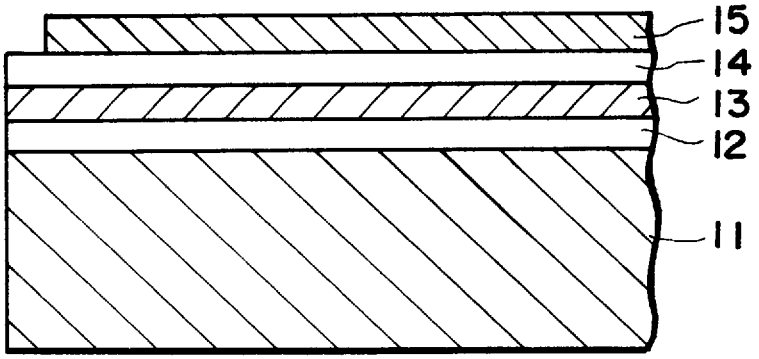
FIG. 4 is a schematic sectional view of an embodiment of a transfer sheet carrying thereon a fixed image used as a first image-carrying member in the invention.

Onto the surface of the transfer layer 14, a toner image is transferred by an electrophotographic apparatus as shown in FIG. 3 specifically described hereinafter. The toner image is then fixed on the transfer layer 14 by fixation means of the apparatus. The transfer layer 14 holds thereon the fixed (toner) image before a re-transfer step thereof onto a second image-carrying material and may preferably exhibit a sufficient peeling performance to the fixed image in the re-transfer step. The first image-carrying member having the fixed image 15 on the transfer layer 14 is shown in FIG. 4.

The transfer layer 14 is required to have a sufficient resistance to moisture (water), and specifically, is required to have an excellent moisture resistance while ensuring a swelling liquid used in the re-transfer step.

More specifically, the transfer layer 14 may preferably comprise a composition (mixture) of a polyvinyl alcohol (A) formed by saponifying polyvinyl acetate at a saponification degree (Sdeg) of at least 90% and a polyvinyl alcohol (B) formed by saponifying polyvinyl acetate at an Sdeg of below 90%. The composition may preferably contain the high-saponified polyvinyl alcohol (A) having an Sdeg of at least 90% in an amount of at least 10 wt. % (on the basis of solid content), preferably 25 wt. % to below 75 wt. %. Below 10 wt. %, a water-soluble characteristic of the low-saponified polyvinyl alcohol (B) component (Sdeg <90%) is liable to be exhibited, whereby the transfer layer 14 is liable to start dissolving in a high temperature environment. Above 75 wt. %, a linear polymer constituting the transfer layer 14 has a high regularity in molecular arrangement or orientation (stereoregularity) as in a cellulose film, so that there is a possibility that a resultant film of the polyvinyl alcohol mixture has a large dimensional change with respect to water (moisture) content in the ambient air.

The transfer layer 14 may further contain an antistatic agent of a cationic type or a nonionic type, as desired, in order to improve an electrophotographic transferability. Such an antistatic agent may preferably be added in an amount sufficient to provide the transfer layer 14 with a surface resistance (Rs) of $10^8$–$10^{12}$ ohm.

Examples of the antistatic agent may include known compounds therefor including electroconductive resins, such as quaternary ammonium salt-type compound, pyridinium salt-type compound, phosphonium salt-type compound, alkylbetaine-type compound, alkylimidazoline-type compound, alkylalanine-type compound, nonionic compound of polyoxyethylene-type, nonionic compound of polyhydric alcohol-type, polyvinylbenzyl-type cationic compound, polyacrylic acid-type cationic compound, resins containing metal oxide fine powder, such as $SnO_2$ powder or $SnO_2$—Sb powder, dispersed therein. The antistatic agent may preferably be added to a coating liquid for forming the transfer layer 14 together with other ingredients therefor (e.g., polyvinyl alcohols (A) and (B)).

The transfer layer 14 may also contain an inorganic white pigment, such as silica (silicon dioxide) fine powder in order to improve a sheet conveyance characteristic and a toner fixability. In case where the peeling layer is constituted by the transfer layer 14 alone, the transfer layer 14 (peeling layer) may preferably contain a larger amount of silica fine powder and an appropriate amount of a silicone compound.

As described above, the first image-carrying layer has a lamination structure (transfer layer 14/release layer 13/adhesive layer 12 (FIG. 1) or transfer layer 14/adhesive layer 12 (FIG. 2)) formed on the support 11.

The adhesive layer 12 may preferably have a small thickness, more preferably 2–10 μm, so as not to cause fracture peeling of its film. Below 2 μm, a resultant film is liable to become unevenness. Above 10 μm, peeling within the adhesive layer 12 is liable to occur. In this case, however, if silica fine powder is incorporated in the adhesive layer 12, the resultant adhesive layer 12 may have a thickness of up to 15 μm because of an enhanced film strength.

The release layer 13 functions as a primer (under coat) layer for the transfer layer 14 and is formed in order to attain a sufficient peeling action at a boundary face between the release layer 13 and the adhesive layer 12. The release layer 13 may preferably have a thickness of 2–6 μm. Above 6 μm, the resultant layer is liable to have a large change in dimensions resulting from a change in water content therein. As a result, the first image-carrying member is liable to cause curl (curling).

The transfer layer 14 may preferably have a thickness of 3–50 μm. Below 3 μm, the peeling layer (comprising the transfer layer 14) is lowered in its strength and accordingly is liable to cause breakage of the peeling layer. Above 50 μm, the peeling layer after peeled from the first image-carrying member becomes hard, the peeling layer is liable to lower its curved-surface follow-up property (adaptability) during the re-transfer step. The transfer layer 14 may more preferably have a thickness of 4–40 μm.

Figure 5:
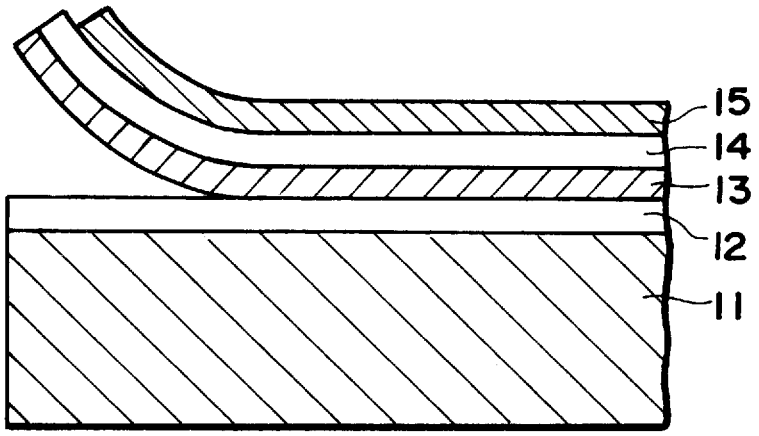
FIGS. 5–7 are schematic sectional views for illustrating the steps of transfer printing of a fixed image from a transfer sheet (first image-carrying member) to a second image-carrying member adopted in the present invention.
Figure 6:
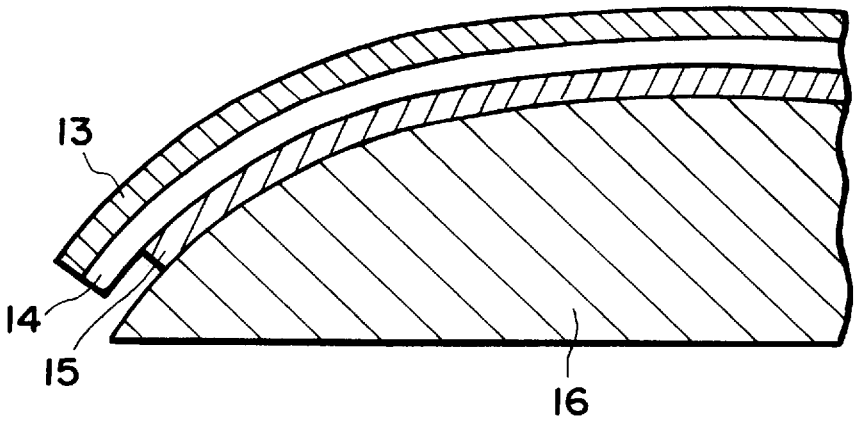
Figure 7:
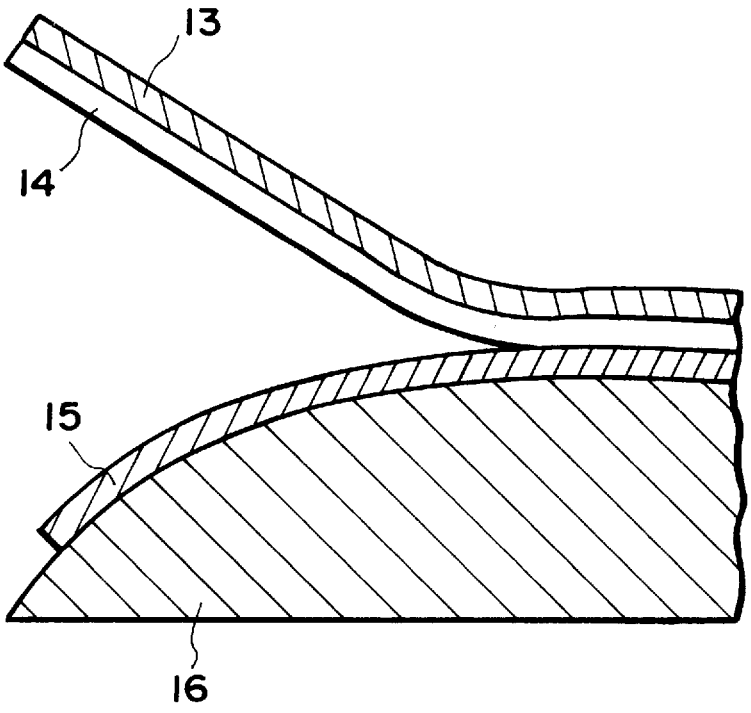

The peeling layer (preferably a lamination layer comprising the release layer 13 and the transfer layer 14) having a fixed image 15 as shown in FIG. 5 is peeled from the adhesive layer 12. Thereafter, as shown in FIG. 6, the fixed image 15 face of the peeling layer is closely attached to the surface of a second image-carrying member 16 and pressed against the second image-carrying member 16 from the release layer 13 side under heating, whereby the fixed image 15 is heat-fixed on the second image-carrying member 16. After the fixation, the peeling layer is caused to swell with a swelling agent (swelling liquid), preferably hydrous alcohols (e.g., hydrous ethanol), which does not substantially dissolve or swell the fixed image 15. Based on the swelling power of the peeling layer at the time of swelling thereof, the peeling (detaching) action is exerted on the interface (boundary face) between the peeling layer and the fixed image 15 fixed on the second image-carrying member 16. For this reason, by swelling the peeling layer, the peeling layer is peeled (released) from the fixed image 15 while leaving the fixed image 15 on the second image-carrying member 16 as shown in FIG. 7, thus effecting transfer printing (re-transfer) of the fixed image 15.

The second image-carrying member may preferably comprise a material free from or not readily cause thermal degradation or thermal deformation.

Examples thereof may include pottery, tile, wood, glass, metal, plastic, composite products of these materials in the form of sheet, composite products of these materials formed by molding or press molding.

After the re-transfer (transfer printing) of the fixed image 15, the surface of the fixed image on the second image-carrying member 16 may be coated with a curable transparent resin, followed by curing to form a transparent (protective) layer thereon, as desired.

Hereinbelow, a toner used in the image forming method of the invention will be specifically described.

In the case of two component-type developer comprising a toner and a carrier, a toner image is formed by charging the toner so as to have a prescribed charge amount and a prescribed charging polarity by the action of friction of the toner with the carrier and by utilizing electrostatic attraction. Accordingly, it is important to obtain a good triboelectric chargeability of the toner principally determined by a relationship between the toner and the carrier.

Particularly, in the case of using a color toner, the following characteristics (conditions) may preferably be satisfied.

(1) A fixed color toner may preferably be placed in a state close to a substantially complete melting-state, in which the shape of color toner particles cannot be recognized, in order not to prevent color reproduction due to an occurrence of irregular reflection with respect to light.

(2) A color toner may preferably have a transparency such that a toner layer does not impair another color tone of a lower toner layer thereof.

(3) Respective color toners (toner components) may preferably have balanced hue and spectral reflection characteristic and a sufficient color saturation.

As a result of our study as to a color toner for electrophotography satisfying the above characteristics and suitable for the above-described image forming method (transfer printing), it has been found that a color toner comprising polyester resin as a binder resin and an organic pigment uniformly dispersed in toner particles may advantageously satisfy stability in charge, fixability, and characteristics required of the above-described transfer image formation (transfer printing).

The color toner applicable to the above transfer image-forming method using a color electrophotographic apparatus may preferably not only show a good melting (fusion) characteristic and an excellent color-mixing characteristic but also has a low melting point and a shorter melting time providing a sharp-melting characteristic. By using the color toner having a sharp-melting characteristic, it is possible to provide a wider color reproduction range of a copy product or print and to obtain well a color image faithful to a multi- or full-color image on an original.

Such a color toner is subjected to the transfer image formation described above wherein a fixed image once obtained is (re-)transferred onto a second image-carrying member (final transfer-receiving material) to form a picture pattern, so that if the fixed image surface has an unevenness, the fixed image is lowered in adhesiveness to the second image-carrying member and is liable to be undesirably peeled therefrom. During the (re-)transfer process, the first image-carrying member is provided with, e.g., alcohol solvent from the other side (opposite to the fixed image side), hereby the alcohol solvent is caused to penetrate through to the interface between the fixed image 15 and the transfer layer 14 to peel the transfer layer 14 from the fixed image 15. Accordingly, it is undesirable that the fixed image 15 is strongly attached to the transfer layer 14 and firmly fixed thereon because the re-transfer of the fixed image 15 is not performed effectively.

For this reason, as a binder resin for the color toner, it is preferable that the binder resin has a good adhesiveness to the transfer layer 14 during the fixation step and a good peeling performance therefrom during the re-transfer step at the same time.

The binder resin may preferably comprise polyester resin in view of fixability and sharp-melting characteristic of a resultant color toner.

Particularly, a polyester resin obtained through polycondensation or copolycondensation between a diol component and a carboxylic acid component.

Examples of the diol component may include bisphenol derivatives represented by the following formula (A) or substituted derivatives thereof:

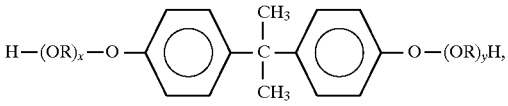

(A)

wherein R denotes ethylene or propylene, and x and y independently denotes an integer of at least 1 satisfying x+y=2–10 (as an average value).

Examples of the carboxylic acid component may include di- or poly-carboxylic acids having at least two carboxylic groups, their anhydrides, and substituted products thereof. Specific examples thereof may include fumaric acid, maleic anhydride, phthalic acid, terephthalic acid, and trimellitic acid.

The above carboxylic acid component may preferably be used in order to provide a resultant polyester resin with a sharp-melting characteristic.

The polyester resin may preferably have an acid value (A.V.) 2–25 mgKOH/g. This is because if the polyester resin has an acid value in the above range, excellent charge stability in respective environmental conditions is attained. Further, the adhesiveness to the transfer layer 14 at the time of the fixation and the peeling performance therefrom at the time of the re-transfer are well satisfied simultaneously.

If the polyester resin has an A.V. of below 2 mgKOH/g, the resultant toner tends to cause charge-up phenomenon and also is liable to be lowered in charge stability and adhesiveness to the transfer layer 14, thus being liable to cause offset during the fixation step. This tendency is particularly noticeably in the case of using the first image-carrying member having the transfer layer 14 containing a mixture of polyvinyl acetate saponified to have an Sdeg of at least 90% (i.e., polyvinyl alcohol (A)) and polyvinyl acetate saponified to have an Sdeg of below 90% (i.e., polyvinylalcohol (B)).

On the other hand, if the polyester resin has an A.V. of above 25 mgKOH/g, charge stability with time of the toner and chargeability of the toner during successive image formation tend to be lowered. Particularly, in a high temperature/high humidity environment, toner scattering and image defects (e.g., fogs) are liable to occur. Further, the toner has an excessively high adhesiveness to the transfer layer 14, whereby anti-offset characteristic with respect to the first image-carrying member at the time of the fixation under heat and pressure is improved but the peeling performance at the time of the re-transfer step is undesirably lowered. For this reason, at the time of the peeling, a large amount of, e.g., alcohol solvent is required in some cases. As a result, a part of the fixed image remains on the transfer layer 14 at the time of the re-transfer, thus failing to perform a good transfer printing in some cases.

The adhesiveness to the transfer layer 14 and peeling performance therefrom of the toner are largely affected by an interaction between hydroxyl group of the polyvinyl alcohol (B)

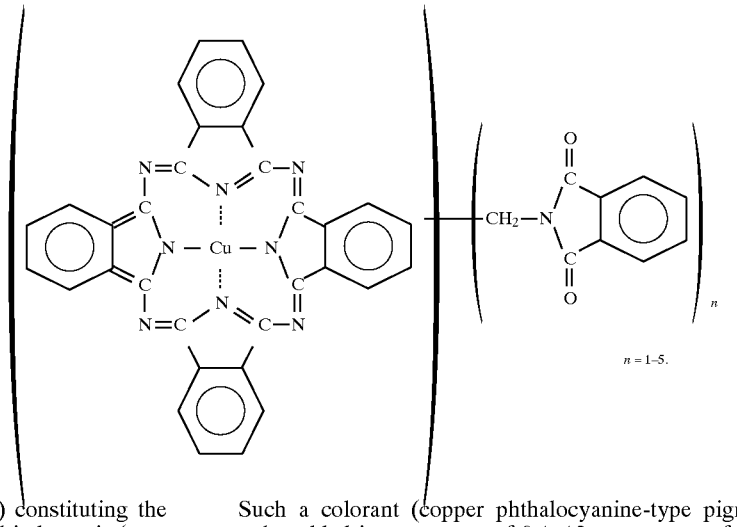

$n = 1–5.$ (preferaly polyvinyl alcohols (A) and (B) constituting the transfer layer 14 and carboxyl group of the binder resin (e.g., polyester resin) constituting the toner. Accordingly, a balance resin) constituting the toner. Accordingly, a balance of an Sdeg of the polyvinyl alcohol mixture and an A.V. of the polyester binder resin becomes an important factor.

In this respect, the polyester resin may preferably have an A.V. of 2–25 mgKOH/g, more preferably 3–22 mgKOH/g, particularly 5–20 mgKOH/g.

The binder resin of the toner may preferably have a weight-average molecular weight (Mw) of 3,000–150,000, more preferably 6,000–100,000, further preferably 7,000–80,000, particularly 8,000–50,000. Further, the binder resin may preferably have a number-average molecular weight (Mn) of 1,500–15,000, more preferably 1,500–10,000, further preferably 2,000–8,000. A ratio of Mw to Mn (Mw/Mn ratio) may preferably be in the range of 2–10, more preferably 3–8, further preferably 3–6.

If the binder resin has an Mw of above 150,000, the fixability and color-mixing characteristic of the toner are lowered. Below 3000, the re-transferability of the fixed image onto the second image-carrying member is lowered.

If the binder resin has an Mn of above 15,000, the fixability and color-mixing characteristic of the toner are lowered. Below 1,500, the anti-blocking characteristic of the toner is lowered.

In case where the Mw/Mn ratio is in the range of 2–10, the resultant toner exhibits excellent characteristics including color-mixing characteristic, fixability, and suppression of attaching to and contaminating the fixation roller surface.

In a chromatic (color) toner, a cyan toner may preferably contain at least a binder resin and a copper phthalocyanine-type organic pigment; a magenta toner may preferably contain at least a binder resin and a quinacridon-type organic and pigment; a yellow toner may preferably contain at least a binder resin and an isoindolinone-type organic pigment. This is because the above color toner provides good performances in respects of chargeability, flowability, spectral reflection characteristic and resistance to light.

Examples of the copper phthalocyanine-type organic pigment may include C.I. Pigment Blue 15; 15:1; 15:2; 15:3; 15:4; and copper phthalocyanine pigments represented by the following formula (B) and having a phthalocyanine skeleton to which 1–5 phthalimidomethyl groups or other substituents are attached:

Such a colorant (copper phthalocyanine-type pigment) may be added in an amount of 0.1–12 wt. parts, preferably 0.5–10 wt. parts, more preferably 1–8 wt. parts, per 100 wt. parts of the binder resin.

Above 12 wt. parts, the cyan toner is lowered in color saturation and color value, thus decreasing color reproducibility.

Examples of the quinacridon-type organic pigment may preferably include C.I. Pigment Red 122, 202, 206 and 207. In case where C.I. pigment Red 122 is used as a base pigment, another colorant may be used in combination.

Examples of another colorant may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 123, 146, 150, 163, 184, 185, 209, 238; C.I. Pigment Violet 19; and C.I. Vat Red 1, 2, 10, 13, 15, 23, 29, 35. These pigments may be used in combination with dyes, such as xanthene dyes.

Such a colorant (quinacridon-type pigment) may be added in an amount of 0.1–15. wt. parts, preferably 1–12 wt. parts, more preferably 1–10 wt. parts, per 100 parts of the binder resin. In case of using the pigment and the dye in combination, the dye may be used in an amount of at most 50 wt. parts, preferably at most 25 wt. parts, per 100 wt. parts of the quinacridon pigment.

Examples of the isoindolinone-type organic pigment may include C.I. Pigment Yellow 109, 110, 139, 173 and 185, particularly C.I. Pigment,Yellow 109 and 173 in terms of charge stability and color reproducibility.

Such a colorant (isoindolinone-type pigment) may be added in an amount of 0.1–15 wt. parts, preferably 2–12 wt. parts, more preferably 3–10 wt. parts, per 100 wt. parts of the binder resin.

The toner may further contain external additives, such as a flowability-improving agent for improving a flowability of the toner after blending, examples of which may include: fine powders of metal oxides, such as silica, alumina, titanium oxide, zironium oxide, magnesium oxide, and hydrophobicity-imparted (surface-treated) products of these fine powders; fine powders of nitrides, such as boron nitride, aluminum nitride, and carbon nitride; and resin fine particles, such as silicone resin fine particles.

Preferred examples of the flowability improving agent may include fine powders of calcium titanate, strontium titanate, barium titanate, magnesium titanate, cerium oxide, zirconium oxide, aluminum oxide, titanium oxide, zinc oxide, silica, and calcium carbonate. Particularly, hydrophobicity-imparted (surface-treated) titanium oxide fine powder having an average primary particle size of 0.01–2 μm may more preferably be used.

The flowability-improving agent may preferably be used not only in order to improve the toner flowability but also so as not to impair the toner chargeability.

The titanium oxide fine powder treated with a hydrophobicity-imparting agent as mentioned above contained in the toner used in the invention shows an excellent flowability-imparting characteristic while retaining a stable chargeability of the toner.

When such a titanium oxide fine powder has an average primary particle size of 0.01–0.2 μm, the resultant toner has a good flowability and shows a uniform chargeability to not readily cause toner scattering and fogs. In addition, titanium oxide particles are not readily embedded in a toner particle surface portion, thus causing little toner deterioration to improve a durability in successive image formation. This tendency is noticeable in the sharp-melt toner (toner having a sharp-melting characteristic).

The titanium oxide particles are treated with a hydrophobicity-imparting agent, whereby the influence thereon of moisture (water content) largely affecting chargeability of the toner is obviated or removed. As a result, a change in charge amount between at a high humidity and at a low humidity is minimized to allow a further improvement in environmental stability and effect uniform charge-impartation to the toner.

When the toner and the above-mentioned titanium oxide are used in combination, the titanium oxide may be used in an amount of 0.5–5.0 wt. %, preferably 0.7–3.0 wt. %, more preferably 1.0–2.5 wt. %, based on the toner weight. This is because the resultant toner containing the titanium oxide has a good flowability and retains a stable chargeability, whereby toner scattering is not caused readily.

The toner used in the invention may preferably have a weight-average particle size (Dav.) of 3–12 μm (preferably 4–10 μm) and may preferably include toner particles having a particle size of 5 μm or smaller at 15–45% by number, toner particles having a particle size of 12.7–16.0 μm at 0.1–5% (preferably 0.1–4%) by volume, and toner particles having a particle size of above 16.0 μm at 1% or below by volume.

If the toner has the above particle size characteristics, the toner per se can be further improved in stable chargeability. Such a toner per se has a very sharp charge distribution, whereby it is possible to not only improve development efficiency but also effectively minimizing fogs in a background of a resultant image.

In addition thereto, the above toner is effective in faithfully reproducing an electrostatic image formed on a photosensitive member and is excellent in a reproducibility of a fine dot-latent image (dotted image or digital image), particularly in gradation characteristic and resolution of a toner image at a high light portion.

It has been considered that toner particles having a particle size of at most 5 μm are not readily controlled to have a prescribed chargeability and lower the toner flowability and constitute a fog component with respect to an image background portion.

In the present invention, such toner particles having a particle size of 5 μm or small are an important component of the toner in order to form a high-quality toner image.

When a toner used for developing an electrostatic image at a potential portion on a photosensitive member is collected and subjected to measurement of particle size distribution, the toner includes a large amount of toner particles having a particle size of at most 8 μm, particularly about 5 μm at a fine dot portion. This is presumably because when toner particles having a particle size of about 5 μm are smoothly supplied to a developing region of an electrostatic image on the photosensitive member, such toner particles are faithful to the electrostatic image and provide a toner image having a good reproducibility of the electrostatic image without deviating from the electrostatic image portion.

Further, by using the toner including toner particles having the above-described specific particle size distribution, the fixability of the fixed image onto the first image-carrying member and the adhesiveness thereof to the second image-carrying member are well attained simultaneously.

In case where the toner has a negative chargeability, a negative charge control agent may preferably be added to the toner in order to further stabilize a negative chargeability. Examples of the negative charge control agent may include a colorless or pale-color organic metal complexes including those of salicylic acid substituted with alkyl group, such as di-tert-butylsalicylic acid metal complex, metal of which is chromium, zinc or aluminum.

In the case of using a positively chargeable toner, the toner may preferably contain a positive charge control agent, examples of which may include triphenylmethane-type compounds, rhodamine-type dyes, and polyvinylpyridine. Particularly, the positive color control agent may preferably be those of colorless or pale color because a color tone of the toner is not adversely affected thereby.

These charge control agents may suitably be contained in the toner in a proportion of 3–10 wt. %, preferably 4–8 wt. % although these agents may used in an appropriate amount not adversely affecting the color tone of the toner.

If the charge control agent is used in an amount in the above range, a change in chargeability at an initial stage is small and an absolute chargeability necessary for development is can be obtained readily, so that an occurrence of fogs and a decrease in image density are effectively suppressed.

Further, the toner used in the invention may contain a lubricant, examples of which may include aliphatic acid metal salt (e.g., zinc stearate, aluminum stearate), and fine powder of fluorine-containing polymer (e.g., fine powders of polytetrafluoroethylene, polyvinylidene fluoride, and tetrafluoroethylene-vinylidene fluoride copolymer).

The toner may also contain an electroconductivity-imparting agent, such as tin oxide or zinc oxide.

The toner may further contain a release agent as a fixation aid, examples of which may include: aliphatic hydrocarbon waxes, oxides thereof, waxes containing aliphatic esters as principal constituents, saturated linear aliphatic acids, unsaturated aliphatic acid, saturated alcohols, polyhydric alcohols, aliphatic acid amides, saturated aliphatic acid bisamides, unsaturated aliphatic acid amides, and aromatic bisamides.

The release agent may preferably used in an amount of 0.1–20 wt. parts, more preferably 0.5–10 wt. parts, per 100 wt. parts of the binder resin. Above 20 wt. parts, anti-blocking characteristic and anti-offset characteristic at high temperatures are liable to be lowered. Below 0.1 wt. part, the release effect becomes insufficient.

The release agent may be uniformly dispersed in the binder resin by a method of mixing the release agent in a solution of the resin at an elevated temperature under stirring or melt-kneading the binder resin together with the release agent.

The toner may preferably be mixed with a carrier to constitute a two component-type developer.

Examples of the carrier may include: surface-oxidized or unoxidized powder of metals, such as iron, nickel, copper, zinc, cobalt, manganese, chromium, magnesium, and rare earth metals, alloys and oxides of these, and magnetic ferrite. The carrier may preferably comprise ferrite particles having a composition of Cu—Zn—Fe (purity=at least 98%, metal composition ratio of (5–20):(5–20):(30–80)) because the ferrite particles are readily provided with a uniform surface and effective in providing stable chargeability.

However, the carrier used in combination with the toner is not particularly limited.

Other examples of the carrier may include ferrites consisting of at least one material, such as powdery iron oxide, copper, manganese, nickel, zinc, tin, magnesium, lead, strontium, barium, lithium and calcium, in various forms including flattened form, spongy form, coin form, spherical form, true sphere form, etc.; and mixture particles comprising various resins and magnetic powders.

In the present invention, the carrier may preferably be coated carrier wherein carrier core particles are surface-coated with a resin. The coated ferrite carrier may be formed by known methods including one wherein a resin (coating material) is dissolved or suspended in a solvent to prepare a coating liquid and the surfaces of carrier core particles are coated with the coating liquid, and one wherein a resin and carrier core particles are simply blended in a powdery state.

The coating material (resin) comprises an electrical insulating resin and may appropriately be selected depending on materials for the toner and carrier core. In order to prevent spent toner (toner (melt-)sticking onto the carrier), a resin having a small surface energy may preferably be used. Examples of such a resin may include silicone resin and fluorine-containing resin. These resins may preferably be mixed with other additives to enhance a film toughness in order to improve an adhesive power to the carrier core particles.

Particularly, in case where the carrier core material is coated with silicone resin, by adding water to a dilute solution of silicone resin in a solvent, the resultant coated carrier is further improved in durability and charging characteristics.

This is presumably because a curing reaction of curable silicone resin is promoted due to increased crosslinking points thereof and accelerated hydrolysis of silane coupling agent by water addition, and the silicone resin has an increased surface energy for a short time to improve the adhesiveness between the carrier core particles and the silicone resin.

The coating material (resin) for the above purpose may be used in a resin solid content of 0.05–10 wt. %, preferably 0.1–5 wt. %, per the carrier core particles.

The carrier may have a particle size of 27–100 $\mu$m, preferably 25–70 $\mu$m, more preferably 25–65 $\mu$m.

In the two component-type developer comprising the toner and the carrier, a toner concentration (toner content) therein may be 1–12 wt. %, preferably 2–9 wt. %. Below 1 wt. %, an image density is liable to be lowered. Above 12 wt. %, fogs and toner (or developer) scattering are liable to occur, thus being liable to shorten the life of the developer.

Hereinbelow, a method of forming a fixed (toner) image on the first image-carrying member according to electrophotography by using a transfer-receiving material (transfer material) in the form of a sheet as the first image-carrying member will be described with reference to FIG. 3.

FIG. 3 is a schematic sectional view of an embodiment of an image forming apparatus for forming a fixed image on the first image-carrying member. The image forming apparatus shown in FIG. 3 is applicable as a full-color copying machine or a full-color printer.

In the case of using the apparatus as the full-color copying machine, as shown in FIG. 3, the copying apparatus includes a digital color image reader unit in an upper portion and a digital color image printer unit in a lower port.

In the image reader unit, an original 30 is placed on an original glass plate 31 and is subjected to scanning exposure with an exposure lamp 32. A reflection light image from the original 30 is concentrated at a full-color sensor 34 to obtain a color decomposition image signal, which is transmitted to an amplifying circuit (not shown) and is transmitted to and treated with a video-treating unit (not shown) to be outputted toward the digital image printer unit.

In the image printer unit, a photosensitive drum 40 as an image-bearing member may, e.g., include a photosensitive layer comprising an organic photoconductor (OPC) and is rotatably supported in a direction of an arrow. Around the photosensitive drum 40, a pre-exposure lamp 41, a corona charger 2, a laser-exposure optical system (3*a*, 3*b*, 3*c*), a potential sensor 42, four developing devices containing developers different in color (4Y, 4C, 4M, 4B), a luminous energy (amount of light) detection means 43, a transfer device, and a cleaning device 6 are disposed.

In the laser exposure optical system, the image signal from the image reader unit is converted into a light signal for image scanning exposure at a laser output unit (not shown). The converted laser light (as the light signal) is reflected by a polygonal mirror 3*a*and projected onto the surface of the photosensitive drum via a lens 3*b* and a mirror 3*c*.

In the printer unit, during image formation, the photosensitive drum 40 is rotated in the direction of the arrow and charge-removed by the pre-exposure lamp 41. Thereafter, the photosensitive drum 40 is negatively charged uniformly by the charger 2 and subjected to exposure to imagewise light E for each decomposed color, thus forming an electrostatic latent image on the photosensitive drum 40.

Then, the electrostatic latent image on the photosensitive drum is developed with a prescribed toner by operating the prescribed developing device to form a toner image on the photosensitive drum 40. Each of the developing devices 4Y, 4C, 4M and 4B performs development by the action of each of eccentric cams 24Y, 24C, 24M and 24B so as to selectively approach the photosensitive drum 40 depending on the corresponding decomposed color.

The transfer device includes a transfer drum 5*a*, a transfer charger 5*b*, an adsorption charger 5*c* for electrostatically adsorbing a recording material, an adsorption roller 5*g* opposite to the adsorption charger 5*c* an inner charger 5*d*, an outer charger 5*e*, and a separation charger 5*h*. The transfer drum 5*a* is rotatably supported by a shaft and has a peripheral surface including an opening portion at which a transfer sheet 5*f* as a recording material-carrying member for carrying the recording material is integrally adjusted. The transfer sheet 5*f* may include a resin film, such as a polycarbonate film.

The transfer sheet 5*f* (as a first image-carrying member) is conveyed from any one of cassettes 7*a*, 7*b* and 7*c* to the transfer drum 5*a* via transfer sheet-carrying system, and is held thereon. The transfer sheet carried on the transfer drum 5 is repeatedly conveyed to a transfer position opposite to the photosensitive drum 1 in accordance with the rotation of the transfer drum 5. The toner image on the photosensitive drum 40 is transferred onto the transfer sheet by the action of the transfer charger 5*b* at the transfer position.

The toner image may be directly transferred to the transfer sheet as shown in FIG. 4. Further, the toner image is once transferred to an intermediate transfer member and then is retransferred from the intermediate transfer member to the transfer sheet.

The above image formation steps are repeated with respect to yellow (Y), magenta (M), cyan (C) and black (B) to form a color image comprising superposed four color toner images on the transfer sheet carried on the transfer drum 5*a*.

The transfer sheet thus subjected to transfer of the toner image (including four color images) is separated from the transfer drum 5*a* by the action of a separation claw 8*a*, a separation and pressing roller 8*b* and the separation charger 5*h* to be conveyed to heat and pressure-fixation device 9, at which the toner image on the transfer sheet is fixed under heating and pressure to effect color-mixing and color development of the toner and fixation of the toner onto the transfer sheet to form a full-color fixed image (fixed full-color image), followed by discharge thereof into a tray 10.

As described above, a full-color copying operation for one sheet is completed. On the other hand, residual toner on the surface of the photosensitive drum 40 is cleaned and removed by the cleaning device 6, and thereafter the photosensitive drum 40 is again subjected to the next image formation.

With respect to the transfer drum 5*a*, an electrode roller and fur brush 44 are oppositely disposed via the transfer sheet, and an oil-removing roller 46 and a backup brush 17 are also oppositely disposed via the transfer sheet. By using these members, powder and/or oil attached to the transfer sheet is cleaned and removed. This cleaning operation is performed before or after image formation. In case of an occurrence of jam phenomenon (paper jamming or plugging), the cleaning operation may appropriately be effected.

An eccentric cam 25 is operated at a desired timing to actuate a cam follower 5 integrally supported to the transfer drum, whereby a gap (spacing) between the transfer sheet and the photosensitive drum can be arbitrarily set. For instance, at the time of stand-by or shut-off of power supply, the gap between the transfer drum 5*a* and the photosensitive drum 40 can be made large.

A full-color fixed image is formed on the transfer layer 14 (e.g., as shown in FIG. 4) on the transfer sheet (first image-carrying member) by the above image forming apparatus. In the above apparatus, image formation may appropriately be performed in a single color mode or a full color mode to provide a single color fixed image or a full color fixed image, respectively.

The thus formed fixed image on the transfer sheet is (re-)transferred onto the second image-carrying member by the above-described method to effect transfer printing.

Various physical parameters characterizing the toner used in present invention may be measured according to the following methods.

(1) Toner particle size distribution

The particle size distribution of a toner sample is measured by means of a Coulter counter in the present invention, while it may be measured in various manners.

Coulter counter TA or Coulter Multisizer (available from Coulter Electronics Inc.) is used as an instrument for measurement.

For measurement, a 1%-NaCl aqueous solution (e.g., ISOTON-R (available from Coulter Scientific Japan C.)) as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40.3 μm (13 channels) by using the above-mentioned Coulter counter with a 100 μm-aperture to obtain a volume-basis distribution and a number-basis distribution. From the results of the volume-basis distribution and number-basis distribution, parameters characterizing the toner used in the present invention may be obtained. More specifically, the weight-basis average particle size Dav. may be obtained from the volume-basis distribution while a central value in each channel is taken as a representative value for each channel.

As the channels, 13 channels including 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.00–25.40 μm: 25.40–32.00 μm; and 32.00–40.30 μm.

(2) Average particle size of titanium oxide

A primary particle size of a powder sample (titanium oxide fine particles) may be determined by observing titanium oxide fine particles through a transmission-type electron microscope (magnification=$3\times10^4$–$5\times10^4$), measuring particle size is of 300 particles (≧0.005 μm) randomly selected in an observation area, and calculating an average value of these particle sizes.

A particle size on toner particles (dispersion particle size) is obtained by first observing 300 titanium oxide fine particles through a scanning electron microscope (magnification=$3\times10^4$–$5\times10^4$), effecting qualitative analysis of the particles (300 particles) in an observation area by means of an X-ray microanalyzer, and measuring their particle sizes to determine an average particle size.

(3) Acid value

2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1 % indicator mixture of bromothymol blue and Phenol Red. The acid value is calculated from the consumption of the KOH/alcohol solution based on the following equation:

$$\text{Acid value}=\text{vol. (ml) of (KOH/alcohol)}\times N\times 56.1/\text{sample weight},$$

wherein N denotes the factor of the N/10 KOH/alcohol solution.

(4) Molecular weight (distribution) of binder resin

The molecular weight (distribution) (Mw, Mn) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution adjusted at a prescribed concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Toso K.K. or Showa Denko K.K. It is appropriate to use at least 10 standard polystyrene samples inclusive of those having molecular weights of on the order of $10^2$–$10^7$. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P available from Showa Denko K.K.; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSK guard column available from Toso K.K.

A sample for measurement may be prepared as follows.

A sample is added in THF and left standing for several hours. After the standing, the mixture was sufficiently shaken until an aggregate or agglomeration disappears and is further left standing for at least 12 hours. In this case, the total standing time of the sample added in THF is set so as to be at least 24 hours. Thereafter, the mixture is filtrated with a sample-treating filter (pore size=0.45–0.5 μm; "MISHORIDISK H-25-5", md. by Toso K.K. or "EDICHRODISK 25CR", mfd. by German Science Japan Co.) to be subjected to a GPC sample. The sample is adjusted to have a resin component concentration of 0.5–5 mg/ml.

(5) Surface resistance

Surface resistance (Rs) of a first image-carrying member and a transfer layer may be measured according to JIS K-6911.

Measurement of the surface resistance is performed by using a measurement apparatus (e.g., "R8340A" and "R12702A", available from Advantest Co. Ltd.) under measurement conditions (temperature=20° C., humidity=65% RH, voltage=100 V).

Hereinbelow, the present invention will be specifically explained based on Examples (including Transfer Sheet Production Examples, Toner Production Examples, Developer Production Examples).

Transfer Sheet Production Example 1

A transfer sheet No. 1 for transfer printing was prepared in the following manner.

<Support>

A one-sidely coated paper prepared by filling (sealing up) an uneven surface of a medium grade (wood-reduced) paper (basis weight=64 g/m$^2$) on its one side with a coating liquid containing starch and talc was used as a support 11.

| <Adhesive layer> | |
|---|---|
| Acrylic resin ("Cover coat resin LO-316", mfd. by Goou Kagaku K.K.) | 100 wt. parts |
| Toluene | 100 wt. parts |

A coating liquid comprising the above ingredients was applied onto the surface of the support 11 by using a lip coater to form a 7 μm-thick adhesive layer 12.

| <Release layer> | |
|---|---|
| High-saponified polyvinyl alcohol aqueous solution (referred to as "PVA-high", saponification degree (Sdeg) = 98%, solid content (S.C.) = 14 wt. %) | 10 wt. parts |
| Water | 90 wt. parts |

A coating liquid comprising the above ingredients was applied onto the surface of the adhesive layer 12 by using a common coater to form a 3 μm-thick release layer 13.

| <Transfer layer> | |
|---|---|
| PVA-high (Sdeg = 98%, S.C. = 14 wt. %) | 50 wt. parts |
| Low-saponified polyvinyl alcohol aqueous solution (referred to as "PVA-low"; Sdeg = 85%, S.C. = 14. wt. %) | 50 wt. parts |
| Antistatic agent (Cationic surfactant) | 2.5 wt. parts |
| Water | 5 wt. parts |

The above ingredients were mixed to prepare a coating liquid. The coating liquid was applied onto the surface of the release layer 13 by using a screen coater, followed by drying for 30 minutes in an environment of 60° C. and 35% RH to form a 16 μm-thick transfer layer 14, whereby transfer sheet No. 1 was prepared.

In the transfer sheet No. 1, an adhesive (peeling) strength (A.S.) between the adhesive layer 12 and a peeling layer consisting of the release layer 13 and the transfer layer 14 was 2.5 g/cm. Further, the peeling layer showed an area expansion ratio ($S_H/S_L$ ratio) of 103.5%, and the transfer layer 14 showed a surface resistance (Rs) of $2\times10^{11}$ ohm.

Transfer Sheet Production Example 2

A transfer sheet No. 2 for transfer printing was prepared in the following manner.

<Support>

A two-sidely coated paper prepared by filling (sealing up) an uneven surface of a wood free paper (basis weight=80 g/m$^2$) on its both sides with a coating liquid containing starch and calcium carbonate was used as a support 11.

| <Adhesive layer> | |
|---|---|
| Acrylic resin ("Cover coat resin LO-316", mfd. by Goou Kagaku K.K.) | 100 wt. parts |
| Toluene | 100 wt. parts |
| Silica fine powder (BET specific surface area ($S_{BET}$ = 150 m$^2$/g) | 3 wt. parts |

A coating liquid comprising the above ingredients was applied onto the surface of the support 11 by using a screen coater to form a 9 μm-thick adhesive layer 12.

| <Release layer> | |
|---|---|
| PVA-high (Sdeg = 99%, S.C. = 14 wt. %) | 20 wt. parts |
| Water | 100 wt. parts |

A coating liquid comprising the above ingredients was applied onto the surface of the adhesive layer 12 by using a screen coater to form a 4 μm-thick release layer 13.

| <Transfer layer> | |
|---|---|
| PVA-high (Sdeg = 98%, S.C. = 14 wt. %) | 50 wt. parts |
| PVA-low (Sdeg = 88%, S.C. = 14 wt. %) | 50 wt. parts |
| Antistatic agent (Cationic surfactant) | 2.5 wt. parts |
| Silica fine powder ($S_{BET}$ = 150 m$^2$/g) | 6 wt. parts |
| Water | 5 wt. parts |

The above ingredients were mixed to prepare a coating liquid. The coating liquid was applied onto the surface of the release layer 13 by using a screen coater, followed by drying for 30 minutes in an environment of 60° C. and 35% RH to form a 7 μm-thick transfer layer 14, whereby transfer sheet No. 1 was prepared.

In the transfer sheet No. 2, the adhesive layer 12 and a peeling layer consisting of the release layer 13 and the transfer layer 14 provided an A.S. of 2.0 g/cm. Further, the peeling layer showed an $S_H/S_L$ ratio of 103.0%, and the transfer layer 14 showed an Rs of $1\times10^{11}$ ohm.

Transfer Sheet Production Example 3 (comparative)

A transfer sheet No. 3 was prepared in the same manner as in Transfer Sheet Production Example 1 except that a transfer layer 14 was prepared by using a coating liquid comprising the following ingredients.

| | |
|---|---|
| PVA-high (Sdeg = 98%, S.C. = 14 wt. %) | 100 wt. parts |
| Antistatic agent (Cationic surfactant) | 2.5 wt. parts |
| Water | 5 wt. parts |

As a result, the peeling layer (transfer layer 14 and release layer 13) and the adhesive layer 12 showed an A.S. of 3.0 g/cm, the peeling layer showed an $S_H/S_L$ ratio of 101.8%, and the transfer layer 14 showed on Rs of $2\times10^{10}$ ohm.

Transfer Sheet Production Example 4 (comparative)

A transfer sheet No. 4 was prepared in the same manner as in Transfer Sheet Production Example 1 except that a transfer layer 14 was prepared by using a coating liquid comprising the following ingredients.

| | |
|---|---|
| PVA-low (Sdeg = 85%, S.C. = 14 wt. %) | 100 wt. parts |
| Antistatic agent (Cationic surfactant) | 2.5 wt. parts |
| Water | 5 wt. parts |

As a result, the peeling layer (transfer layer 14 and release layer 13) and the adhesive layer 12 showed an A.S. of 2.5 g/cm, the peeling layer showed an $S_H/S_L$ ratio of 107.0%, and the transfer layer 14 showed on Rs of $5\times10^{11}$ ohm.

Transfer Sheet Production Example 5 (comparative)

A transfer sheet No. 5 was prepared in the same manner as in Transfer Sheet Production Example 2 except that a transfer layer 14 was prepared by using a coating liquid comprising the following ingredients.

| | |
|---|---|
| PVA-high (Sdeg = 99%, S.C. = 14 wt. %) | 100 wt. parts |
| Antistatic agent (Cationic surfactant) | 2.5 wt. parts |
| Silica fine powder ($S_{BET}$ = 150 $m^2/g$) | 6 wt. parts |
| Water | 5 wt. parts |

As a result, the peeling layer (transfer layer 14 and release layer 13) and the adhesive layer 12 showed an A.S. of 2.5 g/cm, the peeling layer showed an $S_H/S_L$ ratio of 101.6%, and the transfer layer 14 showed on Rs of $1\times10^{10}$ ohm.

Transfer Sheet Production Example 6 (comparative)

A transfer sheet No. 6 was prepared in the same manner as in Transfer Sheet Production Example 2 except that a transfer layer 14 was prepared by using a coating liquid comprising the following ingredients.

| | |
|---|---|
| PVA-low (Sdeg = 88%, S.C. = 14 wt. %) | 100 wt. parts |
| Antistatic aqent (Cationic surfactant) | 2.5 wt. parts |
| Silica fine powder ($S_{BET}$ = 150 $m^2/g$) | 6 wt. parts |
| Water | 5 wt. parts |

As a result, the peeling layer (transfer layer 14 and release layer 13) and the adhesive layer 12 showed an A.S. of 3.0 g/cm, the peeling layer showed an $S_H/S_L$ ratio of 106.5%, and the transfer layer 14 showed on Rs of $3\times10^{11}$ ohm.

Transfer Sheet Production Example 7

A transfer sheet No. 7 was prepared in the same manner as in Transfer Sheet Production Example 1 except that a transfer layer 14 was prepared by using a coating liquid comprising the following ingredients.

| | |
|---|---|
| PVA-high (Sdeg = 98%, S.C. = 14 wt. %) | 70 wt. parts |
| PVA-low (Sdeg = 85%, S.C. = 14 wt. %) | 30 wt. parts |
| Antistatic agent (Cationic surfactant) | 2.5 wt. parts |
| Water | 5 wt. parts |

As a result, the peeling layer (transfer layer 14 and release layer 13) and the adhesive layer 12 showed an A.S. of 3.0 g/cm, the peeling layer showed an $S_H/S_L$ ratio of 102.0%, and the transfer layer 14 showed on Rs of $5\times10^{10}$ ohm.

Transfer Sheet Production Example 8

A transfer sheet No. 8 was prepared in the same manner as in Transfer Sheet Production Example 2 except that a transfer layer 14 was prepared by using a coating liquid comprising the following ingredients.

| | |
|---|---|
| PVA-high (Sdeg = 99%, S.C. = 14 wt. %) | 100 wt. parts |
| PVA-low (Sdeg = 88%, S.C. = 14 wt. %) | 30 wt. parts |
| Antistatic agent (Cationic surfactant) | 2.5 wt. parts |
| Silica fine powder ($S_{BET}$ = 150 $m^2/g$) | 6 wt. parts |
| Water | 5 wt. parts |

As a result, the peeling layer (transfer layer 14 and release layer 13) and the adhesive layer 12 showed an A.S. of 3.5 g/cm, the peeling layer showed an $S_H/S_L$ ratio of 102.5%, and the transfer layer 14 showed on Rs of $2\times10^{10}$ ohm.

Transfer Sheet Production Example 9

A transfer sheet No. 9 was prepared in the same manner as in Transfer Sheet Production Example 2 except that a transfer layer 14 was prepared by using a coating liquid comprising the following ingredients.

| | |
|---|---|
| PVA-high (Sdeg = 99%, S.C. = 14 wt. %) | 50 wt. parts |

-continued

| | |
|---|---|
| PVA-low (Sdeg = 88%, S.C. = 14 wt. %) | 50 wt. parts |
| Antistatic agent (Cationic surfactant) | 2.5 wt. parts |
| Water | 5 wt. parts |

As a result, the peeling layer (transfer layer 14 and release layer 13) and the adhesive layer 12 showed an A.S. of 2.5 g/cm, the peeling layer showed an $S_H/S_L$ ratio of 103.0%, and the transfer layer 14 showed on Rs of $5\times10^{10}$ ohm.

Transfer Sheet Production Example 10

A transfer sheet No. 10 was prepared in the same manner as in Transfer Sheet Production Example 2 except that a transfer layer 14 was prepared by using a coating liquid comprising the following ingredients.

| | |
|---|---|
| PVA-high (Sdeg = 99%, S.C. = 14 wt. %) | 50 wt. parts |
| PVA-low (Sdeg = 88%, S.C. = 14 wt. %) | 50 wt. parts |
| Silica fine powder ($S_{BET}$ = 150 $m^2/g$) | 6 wt. parts |
| Water | 5 wt. parts |

As a result, the peeling layer (transfer layer 14 and release layer 13) and the adhesive layer 12 showed an A.S. of 2.5 g/cm, the peeling layer showed an $S_H/S_L$ ratio of 103.0%, and the transfer layer 14 showed on Rs of $2\times10^{12}$ ohm.

Transfer Sheet Production Example 11

A transfer sheet No. 11 was prepared in the same manner as in Transfer Sheet Production Example 2 except that a transfer layer 14 was prepared by using a coating liquid comprising the following ingredients.

| | |
|---|---|
| PVA-high (Sdeg = 99%, S.C. = 14 wt. %) | 50 wt. parts |
| PVA-low (Sdeg = 88%, S.C. = 14 wt. %) | 50 wt. parts |
| Antistatic agent (Cationic surfactant) | 7.5 wt. parts |
| Silica fine powder ($S_{BET}$ = 150 $m^2/g$) | 6 wt. parts |
| Water | 5 wt. parts |

As a result, the peeling layer (transfer layer 14 and release layer 13) and the adhesive layer 12 showed an A.S. of 3.0 g/cm, the peeling layer showed an $S_H/S_L$ ratio of 103.0%, and the transfer layer 14 showed on Rs of $5\times10^{7}$ ohm.

Transfer Sheet Production Example 12

A transfer sheet No. 12 for transfer printing was prepared in the same manner as in Transfer Sheet Production Example 2 except that a release layer 13 was not used and other layers were prepared in the following manner.

<Support>

A two-sidely coated paper (paper coated on both sides) prepared by filling (sealing up) an uneven surface of a wood free paper (basis weight=80 $g/m^2$) with a mixture of starch and calcium carbonate was used as a support 11.

<Adhesive layer>

| | |
|---|---|
| Acrylic resin ("Cover coat resin LO-316", mfd. by Goou Kagaku K.K.) | 100 wt. parts |
| Toluene | 100 wt. parts |
| Silica fine powder (BET specific surface area ($S_{BET}$ = 150 $m^2/g$) | 4 wt. parts |

A coating liquid comprising the above ingredients was applied onto the surface of the support 11 by using a screen coater to form a 9 $\mu$m-thick adhesive layer 12.

<Transfer layer>

| | |
|---|---|
| PVA-high (Sdeg = 99%, S.C. = 14 wt. %) | 50 wt. parts |
| PVA-low (Sdeg = 88%, S.C. = 14 wt. %) | 50 wt. parts |
| Antistatic agent (Cationic surfactant) | 2.5 wt. parts |
| Silica fine powder ($S_{BET}$ = 150 $m^2/g$) | 6 wt. parts |
| Silicone ("KM73", mfd. by Shin-Etsu Kagaku K.K.) | 4 wt. parts |
| Water | 5 wt. parts |

In the transfer sheet No. 2, the adhesive layer 12 and the transfer layer 14 provided an A.S. of 2.0 g/cm. Further, the transfer (peeling) layer showed an $S_H/S_L$ ratio of 103.5%, and the transfer layer 14 showed an Rs of $5\times10^{10}$ ohm.

The results of physical properties described above are also summarized in Table below.

TABLE 1

| Transfer sheet Nos. | $S_H/S_L$ ratio (%) | Rs (ohm.) | A.S. (g/cm) |
|---|---|---|---|
| 1 | 103.5 | $2\times10^{11}$ | 2.5 |
| 2 | 103.0 | $1\times10^{11}$ | 2.0 |
| 3 (comp.) | 101.8 | $2\times10^{10}$ | 3.0 |
| 4 (comp.) | 107.0 | $5\times10^{11}$ | 2.5 |
| 5 (comp.) | 101.6 | $1\times10^{10}$ | 2.5 |
| 6 (comp.) | 106.5 | $3\times10^{11}$ | 3.0 |
| 7 | 102.0 | $5\times10^{10}$ | 3.0 |
| 8 | 102.5 | $2\times10^{10}$ | 3.5 |
| 9 | 103.0 | $5\times10^{10}$ | 2.5 |
| 10 | 103.0 | $2\times10^{12}$ | 2.5 |
| 11 | 103.0 | $5\times10^{7}$ | 3.0 |
| 12 | 103.5 | $5\times10^{10}$ | 2.0 |

Toner Production Example 1

| | |
|---|---|
| Polyester resin No. 1 (obtained through condensation polymerization of propoxybisphenol A and fumaric acid; acid value (A.V.) = 10.8 mgKOH/g) | 100 wt. parts |
| Cyan colorant (C.I. Pigment Blue 15:3) | 4 wt. parts |
| Negative charge control agent (Chromium complex compound) | 4 wt. parts |

The above ingredients were sufficiently pre-mixed by a Henschel mixer and melt-kneaded through a product was coarsely crushed by a hammer mill to provide a particle size of c.a. 1–2 $\mu$m, and finely pulverized by an air jet stream pulverizer. The pulverized product was classified by a multi-division classifier to remove a fine powder fraction and a coarse powder fraction at the same time, whereby a cyan toner was obtained.

Separately, 100 wt. parts of hydrophobic titanium oxide fine powder (average primary particle size=0.02 μm, $S_{BET}$= 140 $m^2$//g) was surface-treated with 20 wt. parts of a silane compound (n—$C_4H_9$—$Si(OCH_3)_3$) to prepare hydrophobic titanium oxide fine powder (average primary particle size= 0.02 μm, hydrophobic degree=70%).

100 wt. parts of the above-prepared cyan toner and 1.5 wt. parts of the above-prepared hydrophobic titanium oxide fine powder as a flowability improver (external additive) were mixed to obtain cyan toner No. 1 (C-toner No. 1) carrying hydrophobic titanium oxide fine powder on the surface of toner particles.

Toner Production Examples 2–4

Magenta toner No. 1 (M-toner No. 1), yellow toner No. 1 (Y-toner No. 1), and black toner No. 1 (B-toner No. 1) each containing externally-added hydrophobic titanium oxide fine powder were prepared in the same manner as in Toner Production Example 1 except that 4 wt. parts of the cyan colorant was changed to 5 wt. parts of magenta colorant (C.I. Pigment Red 122), 6 wt. parts of yellow colorant (C.I. Pigment Yellow 173, and 5 wt. parts of black colorant (carbon black), respectively.

Developer Production Examples 1–4

5 wt. parts of C-toner No. 1 and 95 wt. parts of Cu—Zn—Fe-based magnetic ferrite carrier particles (average paticle size=50 μm) surface-coated with silicone resin were mixed to prepare two component-type developer No. 1 for cyan (C-developer No. 1).

Similarly, by using M-toner No. 1, Y-toner No. 1 and B-toner No. 1; two component-type developer No 1 for magenta (M-developer No. 1), two component-type developer No. 1 for yellow (Y-developer No. 1) and two component-type developer No. 1 or black (B-developer No. 1) were prepared, respectively.

Toner Production Examples 5–8

C-toner No. 2, M-toner No. 2, Y-toner No. 2 and B-toner No. 2 were prepared in the same manner as in Toner Production Examples 1–4 except for using polyester resin No. 2 obtained through condensation polymerization of propoxy bisphenol A and fumaric acid (A.V.=1.9 mgKOH/g), respectively.

Developer Production Examples 5–8

C-developer No 2, M-developer No. 2, Y-developer No. 2 and B-developer No. 2 were prepared in the same manner as in Developer Production Examples 1–4 except for using C-toner No. 2, M-toner No. 2, Y-toner No. 2 and B-toner No. 2, respectively.

Toner Production Examples 9–12

C-toner No. 3, M-toner No. 3, Y-toner No. 3 and B-toner No. 3 were prepared in the same manner as in Toner Production Examples 1–4 except for using polyester resin No. 3 obtained through condensation polymerization of propoxy bisphenol A and fumaric acid (A.V.=25.4 mgKOH/g), respectively.

Developer Production Examples 9–12

C-developer No 3, M-developer No. 3, Y-developer No. 3 and B-developer No. 3 were prepared in the same manner as in Developer Production Examples 1–4 except for using C-toner No. 3, M-toner No. 3, Y-toner No. 3 and B-toner No. 3, respectively.

Toner Production Examples 13–16

C-toner No. 4, M-toner No. 4, Y-toner No. 4 and B-toner No. 4 were prepared in the same manner as in Toner Production Examples 1–4 except for using (styrene/n-butyl acrylate/mono-n-butyl maleate (77/16/7 in copolymerization ratio)), respectively.

Developer Production Examples 13–16

C-developer No 4, M-developer No. 4, Y-developer No. 4 and B-developer No. 4 were prepared in the same manner as in Developer Production Examples 1–4 except for using C-toner No. 4, M-toner No. 4, Y-toner No. 4 and B-toner No. 4, respectively.

Toner Production Examples 17–20

C-toner No. 5, M-toner No. 5, Y-toner No. 5 and B-toner No. 5 were prepared in the same manner as in Toner Production Examples 1–4 except for using polyester resin No. 4 obtained through condensation polymerization of propoxy bisphenol A and fumaric acid (A.V.=11.3 mgKOH/g), respectively.

Developer Production Examples 17–20

C-developer No 5, M-developer No. 5, Y-developer No. 5 and B-developer No. 5 were prepared in the same manner as in Developer Production Examples 1–4 except for using C-toner No. 5, M-toner No. 5, Y-toner No. 5 and B-toner No. 5, respectively.

Toner Production Examples 21–24

C-toner No. 6, M-toner No. 6, Y-toner No. 6 and B-toner No. 6 were prepared in the same manner as in Toner Production Examples 1–4 except for using polyester resin No. 5 obtained through condensation polymerization of propoxy bisphenol A and fumaric acid (A.V.=9.7 mgKOH/g), respectively.

Developer Production Examples 21–24

C-developer No 6, M-developer No. 6, Y-developer No. 6 and B-developer No. 6 were prepared in the same manner as in Developer Production Examples 1–4 except for using C-toner No. 6, M-toner No. 6, Y-toner No. 6 and B-toner No. 6, respectively.

Toner Production Example 25

M-toner No. 7 was prepared in the same manner as in Toner Production Example 2 except for using 3.5 wt. parts of magenta colorant (C.I. Pigment Red 57:1).

Developer Production Example 25

M-developer No. 7 was prepared in the same manner as in Developer Production Example 2 except for using M-toner No. 7.

Toner Production Example 26

Y-toner No. 7 was prepared in the same manner as in Toner Production Example 3 except for using 4 wt. parts of yellow colorant (C.I. Pigment Yellow 12).

Developer Production Example 26

Y-developer No. 7 was prepared in the same manner as in Developer Production Example 3 except for using Y-toner No. 7.

Toner Production Example 27

C-toner No. 7 having an weight-average particle (Dav.) size of 13 μm was prepared in the same manner as in Toner Production Example 1.

Developer Production Example 27

C-developer No 7 was prepared in the same manner as in Developer Production Example 1 except for using C-toner No. 7.

Toner Production Example 28

C-toner No. 8 was prepared in the same manner as in Toner Production Example 1 except for using hydrophobic silica fine powder surface-treated with dimethyldichlorosilane ($S_{BET}$=200 $m^2/g$) instead of the hydrophobic titanium oxide fine powder.

Developer Production Example 28

C-developer No 8 was prepared in the same manner as in Developer Production Example 1 except for using C-toner No. 8.

The characterizing data of the above-prepared respective color toners are summarized in Table 2 below.

TABLE 2

| Color toners | Binder resin | Particle size characteristics | | | |
|---|---|---|---|---|---|
| | | Dav. (μm) | Number % of ≦5 μm | Volume % of 12.7–16.0 μm | Volume % of >16.0 μm |
| C-toner No. 1 | Polyester resin No. 1*1 | 8.0 | 31 | 1.8 | 0 |
| M-toner No. 1 | " | 7.9 | 33 | 1.7 | 0 |
| Y-toner No. 1 | " | 8.1 | 30 | 1.9 | 0 |
| B-toner No. 1 | " | 8.2 | 29 | 2.0 | 0 |
| C-toner No. 2 | Polyester resin No. 2*2 | 8.2 | 29 | 2.0 | 0 |
| M-toner No. 2 | " | 8.3 | 28 | 2.2 | 0 |
| Y-toner No. 2 | " | 8.0 | 31 | 1.8 | 0 |
| B-toner No. 2 | " | 8.3 | 28 | 2.2 | 0 |
| C-toner No. 3 | Polyester resin No. 3*3 | 7.9 | 34 | 1.7 | 0 |
| M-toner No. 3 | " | 7.8 | 36 | 1.6 | 0 |
| Y-toner No. 3 | " | 8.0 | 30 | 1.8 | 0 |
| B-toner No. 3 | " | 8.2 | 29 | 2.1 | 0.1 |
| C-toner No. 4 | Styrene copolymer*4 | 8.5 | 28 | 2.4 | 0.2 |
| M-toner No. 4 | " | 8.3 | 28 | 2.2 | 0.1 |
| Y-toner No. 4 | " | 8.5 | 26 | 2.4 | 0.2 |
| B-toner No. 4 | " | 8.6 | 25 | 2.5 | 0.3 |
| C-toner No. 5 | Polyester resin No. 4*5 | 8.1 | 26 | 1.9 | 0 |
| M-toner No. 5 | " | 8.1 | 26 | 1.9 | 0 |
| Y-toner No. 5 | " | 8.2 | 25 | 2.0 | 0.1 |
| B-toner No. 5 | " | 8.3 | 25 | 2.1 | 0.2 |
| C-toner No. 6 | Polyester resin No. 5*6 | 8.0 | 30 | 1.7 | 0 |
| M-toner No. 6 | " | 8.0 | 30 | 1.8 | 0 |
| Y-toner No. 6 | " | 8.1 | 28 | 1.9 | 0 |
| B-toner No. 6 | " | 8.2 | 27 | 2.1 | 0.1 |
| M-toner No. 7 | Polyester resin No. 1 | 8.2 | 28 | 2.2 | 0.1 |
| Y-toner No. 7 | Polyester resin No. 1 | 7.9 | 32 | 1.8 | 0 |
| C-toner No. 7 | Polyeser resin No. 1 | 13.0 | 12 | 6.2 | 1.2 |
| C-toner No. 8 | Polyeser resin No. 1 | 8.0 | 32 | 1.9 | 0 |

(Notes to Table 2)
*1: Mw = 12,600, Mn = 4,200, Mw/Mn = 3.0, A.V. = 10.8
*2: Mw = 14,200, Mn = 4,200, Mw/Mn = 3.4, A.V. = 1.9
*3: Mw = 16,400, Mn = 4,400, Mw/Mn = 3.7, A.V. = 25.2
*4: Mw = 18,000, Mn = 5,000, Mw/Mn = 3.6, A.V. = 12.2
*5: Mw = 108,000, Mn = 6,800, Mw/Mn = 15.9, A.V. = 11.3
*6: Mw = 5,900, Mn = 2,400, Mw/Mn = 2.5, A.V. = 9.7

(Example 1)

A fixed full-color toner image having mirror-image relationship with an original image (full-color image) was formed on a transfer layer 14 of transfer sheet No. 1 by using a full-color laser copying apparatus ("CLC 7001", mfd. by Canon K.K.) as schematically illustrated in FIG. 3 using two component-type developers for four colors (C-developer No. 1, M-developer No. 1, Y-developer No. 1, and B-developer No. 1 respectively containing C-toner No. 1, M-toner No. 1, Y-toner No. 1 and B-toner No. 1).

As a result, the resultant fixed full-color image was formed on the transfer layer 14 as a mirror image faithful to the original full-color image while retaining a good color tone reproducibility without causing offset phenomenon and winding (attachment) of transfer sheet No. 1 around (onto) a heat and pressure-fixation roller.

A peeling layer (comprising the transfer layer 14 an a release layer 13) having thereon the fixed full-color image was peeled from an adhesive layer 12 and closely attached to coated board paper, followed by heat fixation of the fixed full-color image onto coated board paper (as second image-carrying member) by heating and pressing the release layer 13 with a home iron temperature-controlled at 110° C.

Then, the release layer 13 and the transfer layer 14 were swollen with 10%-hydrous ethanol solution, whereby the peeling layer comprising the release layer 13 and the transfer layer 14 was readily peeled from the fixed full-color image. The fixed full-color image remaining on the coated board paper showed a faithful original reproducibility, thus performing a good transfer printing (re-transfer).

When the fixed full-color image on the coated board paper was subjected to light-resistance test according to JIS-K7102 the resultant fixed full-color image was not changed in its color tone even after effecting light irradiation for 400 hours, thus exhibiting a good resistance to light.

When the above transfer printing was performed by using an iron plate (as second image-forming member) instead of the coated board paper, a good fixed full-color image was also obtained.

Further, when transfer sheet No. 1 was left standing for 24 hours in a high temperature/high humidity environment (30° C., 80% RH), a good resistance to moisture was confirmed. Similarly, when transfer sheet No. 1 was left standing for 24 hours in a normal temperature/normal humidity environment (20° C., 10% RH), transfer sheet No. 1 merely showed a small change in dimensions. As a result, transfer sheet No. 1 substantially caused no curl or a slight curl in the form of a projection with respect to the transfer layer surface.

(Example 2)

Transfer printing of a fixed image onto coated board paper was performed in the same manner as in Example 1 except for using transfer sheet No. 2.

As a result, similarly as in Example 1, transfer sheet No. 2 showed good results.

(Comparative Example 1)

Transfer printing of a fixed image onto coated board paper was effected in the same manner as in Example 1 except for using transfer sheet No. 3.

As a result thereof, due to a small area expansion ratio ($S_H/S_L$ ratio=101.8%), the (re-)transferred fixed full-color image showed a partial lack of image in a thin-line image portion.

(Comparative Example 2)

Transfer printing of a fixed image onto coated board paper was effected in the same manner as in Example 1 except for using transfer sheet No. 4.

As a result thereof, due to a large area expansion ratio ($S_H/S_L$ ratio=107.0%), peeling force of the peeling layer become too large, thus resulting in a partial peeling failure portion (partial lack of image). Consequently, the resultant fixed full-color image included portions different in color tone from the original image.

(Comparative Example 3)

Transfer printing of a fixed image onto coated board paper was effected in the same manner as in Example 2 except for using transfer sheet No. 5.

As a result thereof, due to a small area expansion ratio ($S_H/S_L$ ratio=101.6%), the (re-)transferred fixed full-color image showed a partial lack of image in a thin-line image portion.

(Comparative Example 4)

Transfer printing of a fixed image onto coated board paper was effected in the same manner as in Example 2 except for using transfer sheet No. 6.

As a result thereof, due to a large area expansion ratio ($S_H/S_L$ ratio=106.5%), peeling force of the peeling layer becomes too large, thus resulting in a partial peeling failure portion (partial lack of image). Consequently, the resultant fixed full-color image included portions different in color tone from the original image.

(Examples 3–8)

Transfer printing of a fixed image onto coated board paper was performed in the same manner as in Example 1 except for using transfer sheets Nos. 7–12.

As a result, similarly as in Example 1, transfer sheets Nos. 7–12 showed good results, respectively.

(Example 9)

Transfer printing of the fixed image onto coated board paper was effected in the same manner as in Example 1 except for using C-developer No. 2 containing C-toner No. 2, M-developer No. 2 containing M-toner No. 2, Y-developer No. 2 containing Y-toner No. 2, and B-developer No. 2 containing B-toner No. 2 as two component-type developers.

As a result, offset phenomenon was somewhat confirmed (at a rate of 1 sheet per about 10 sheets) during image formation of the fixed full-color image onto transfer sheet No. 1 but the fixed full-color image re-transferred onto coated board paper was of a practically acceptable level.

(Example 10)

Transfer printing of the fixed image onto coated board paper was effected in the same manner as in Example 1 except for using C-developer No. 3 containing C-toner No. 3, M-developer No. 3 containing M-toner No. 3, Y-developer No. 3 containing Y-toner No. 3, and B-developer No. 3 containing B-toner No. 3 as two component-type developers.

As a result, due to a high fixing (adhesive) force between the fixed full-color image and the transfer layer of the peeling layer, a large amount of hydrous ethanol solution was used compared with that used in Example 1 at the time of peeling the fixed full-color image from the peeling layer but the fixed full-color image re-transferred onto coated board paper was of a practically acceptable level.

(Example 11)

Transfer printing of the fixed image onto coated board paper was effected in the same manner as in Example 1 except for using C-developer No. 4 containing C-toner No. 4, M-developer No. 4 containing M-toner No. 4, Y-developer No. 4 containing Y-toner No. 4, and B-developer No. 4 containing B-toner No. 4 as two component-type developers.

As a result, the respective color toners used were inferior to those used in Example 1 in color-mixing characteristic. Further, the resultant full-color image was inferior to that obtained in Example in color tone reproducibility but was of a practically acceptable level.

(Example 12)

Transfer printing of the fixed image onto coated board paper was effected in the same manner as in Example 1 except for using C-developer No. 5 containing C-toner No. 5, M-developer No. 5 containing M-toner No. 5, Y-developer No. 5 containing Y-toner No. 5, and B-developer No. 5 containing B-toner No. 5 as two component-type developers.

As a result, the respective color toners used were inferior to those used in Example 1 in color-mixing characteristic. Further, the resultant full-color image was inferior to that obtained in Example in color tone reproducibility but was of a practically acceptable level.

(Example 13)

Transfer printing of the fixed image onto coated board paper was effected in the same manner as in Example 1 except for using C-developer No. 6 containing C-toner No. 6, M-developer No. 6 containing M-toner No. 6, Y-developer No. 6 containing Y-toner No. 6, and B-developer No. 6 containing B-toner No. 6 as two component-type developers.

As a result, the fixed full-color image formed on coated board paper was of a practically acceptable level but the surface of a heating roller used for forming the fixed image on transfer sheet No. 1 with that used in Example 1.

(Example 14)

Transfer printing of a magenta fixed-image onto coated board paper in a single-color mode was effected in the same manner as in Example 1 except for using M-developer No. 7 containing M-toner No. 7.

As a result, when compared with the case of a single-color mode transfer printing using M-developer No. 1 used in Example 1, the resultant magenta fixed-image provided a coarse image at a highlight image portion (having a halftone image density).

However, the fixed image was still of a practically acceptable used.

(Example 15)

Transfer printing of a yellow fixed-image onto coated board paper in a single-color mode was effected in the same manner as in Example 1 except for using Y-developer No. 7 containing Y-toner No. 7.

As a result, when compared with the case of a single-color mode transfer printing using Y-developer No. 1 used in Example 1, the resultant yellow fixed-image provided a coarse image at a highlight image portion and also was inferior in light resistance.

However, the fixed image was still of a practically acceptable used.

(Example 16)

Transfer printing of a cyan fixed-image onto coated board paper in a single-color mode was effected in the same manner as in Example 1 except for using C-developer No. 7 containing C-toner No. 7.

As a result, when compared with the case of a single-color mode transfer printing using C-developer No. 1 used in Example 1, the resultant cyan fixed-image was inferior in thin line reproducibility, reproducibility in a highlight portion and gradation characteristic. Further, adhesion between the fixed image and the coated board paper was lowered than that in Example 1 during the step of transferring the image from the peeling layer to the coated board paper.

However, the fixed image was still of a practically acceptable used.

(Example 17)

Transfer printing of a cyan fixed-image onto coated board paper in a single-color mode was effected in the same manner as in Example 1 except for using C-developer No. 8 containing C-toner No. 8.

As a result, when compared with the case of a single-color mode transfer printing using C-developer No. 1 used in Example 1, the resultant cyan fixed-image showed an image density largely varying depending on environmental conditions (normal temperature/normal humidity, low temperature/low humidity, and high temperature/high humidity) and also was inferior in reproducibility in a highlight portion.

However, the fixed image was still of a practically acceptable used.

What is claimed is:

1. An image forming method, comprising the steps of:

forming a toner image with a toner comprising toner particles and an external additive on a surface of a first image-carrying member comprising a support and a lamination layer disposed thereon containing a peeling layer, fixing the toner image on the surface of the peeling layer of the first image-carrying member to form a fixed image, peeling the peeling layer having the fixed image from the first image-carrying member, and transferring the fixed image on the peeling layer onto a second image-carrying member while swelling the peeling layer, wherein the lamination layer at least comprises the peeling layer and an adhesive layer, the peeling layer at least comprising a transfer layer and having an area expansion ratio of 102–106%.

2. A method according to claim 1, wherein the toner image is fixed on the peeling layer surface of the first image-bearing member under heat and pressure.

3. A method according to claim 1, wherein the fixed image is transferred from the peeling layer to the second image-carrying member by pressing the peeling layer against the second image-carrying member via the fixed image under heating.

4. A method according to claim 1, wherein the transfer layer comprises a composition comprising a first polyvinyl alcohol having a saponification degree of at least 90% and a second polyvinyl alcohol having a saponification degree of below 90%, the first polyvinyl alcohol having a solid content of 25–75 wt. % per the transfer layer on a solid matter basis.

5. A method according to claim 1, wherein the toner particles comprise a binder resin and a colorant, the binder resin comprising polyester resin or styrene copolymer.

6. A method according to claim 5, wherein the polyester resin has an acid value of 2–25 mgKOH/g.

7. A method according to any one of claims 1–6, wherein the toner image is formed by a toner selected from the group consisting of a cyan toner containing a copper phthalocyanine pigment, a magenta toner containing a quinacridon pigment, a yellow toner containing an isoindolinone pigment, and a black toner.

8. A method according to any one of claims 1–6, wherein the toner has a weight-average particle size of 3–12 $\mu$m and includes toner particles having a particle size of 5 $\mu$m or smaller at 15–45% by number, toner particles having a particle size of 12.7–16.0 $\mu$m at 0.1–5% by volume, and toner particles having a particle size of above 16.0 $\mu$m at 1% or below by volume.

9. A method according to claim 8, wherein the toner has a weight-average particle size of 4–10 $\mu$m and includes toner particles having a particle size of 12.7–16.0 $\mu$m at 0.1–4% by volume.

10. A method according to claim 5, wherein the binder resin has a weight-average molecular weight (Mw) of 3,000–150,000 and a number-average molecular weight (Mn) of 1,500–15,000.

11. A method according to claim 10, wherein the binder resin has an Mw of 3,000–100,000, an Mn of 1,500–10,000, and a ratio (Mw/Mn) therebetween of 2–10.

12. A method according to claim 1, wherein the toner has a weight-average particle size of 4–10 $\mu$m and comprises titanium oxide fine particles having an average primary particle size of 0.01–0.2 $\mu$m.

13. A method according to claim 12, wherein said titanium oxide fine particles comprise hydrophobic titanium oxide fine particles.

14. A method according to claim 1, wherein the transfer layer has a surface resistance of $10^8$–$10^{12}$ ohm in an environment including a temperature of 20° C. and a humidity of 65% RH.

15. A method according to claim 1, wherein the transfer layer comprises silica fine powder.

16. A method according to claim 1, wherein the first image-carrying member is in the form of a sheet and comprises the lamination layer including the peeling layer disposed on one of the surfaces of the support.

17. A method according to claim 1, wherein the fixed image is transferred from the peeling layer to the second image-carrying member, by pressing the peeling layer against the second image-carrying member via the fixed image under heating to effect adhesion of the fixed image to the second image-carrying member, and peeling the peeling layer from the fixed image after swelling the peeling layer.

18. A method according to claim 17, wherein the peeling layer is peeled from the fixed image after swelling the peeling layer with hydrous alcohol.

* * * * *

UNITED STATES PATENT AND TRADEMARK OFFICE

CERTIFICATE OF CORRECTION

PATENT NO. : 5,842,097

DATED : November 24, 1998

INVENTOR(S) : MAKOTO KANBAYASHI, ET AL.

It is certified that error appears in the above-identified patent and that said Letters Patent is hereby corrected as shown below:

COLUMN 1:

Line 36, "provide" should read --provided--.
Line 48, "cause" should read --causes--.

COLUMN 2:

Line 1, "each other" should be deleted.

COLUMN 5:

Line 5, "undesirable" should read --undesirably--.

COLUMN 6:

Line 21, "unevenness." should read --uneven.--.
Line 66, "cause" should read --causing--.

COLUMN 8:

Line 46, "noticeably" should read --noticeable--.

COLUMN 9:

Line 57, "and" should be deleted.

UNITED STATES PATENT AND TRADEMARK OFFICE

CERTIFICATE OF CORRECTION

PATENT NO. : 5,842,097

DATED : November 24, 1998

INVENTOR(S) : MAKOTO KANBAYASHI, ET AL.

It is certified that error appears in the above-identified patent and that said Letters Patent is hereby corrected as shown below:

COLUMN 10:

Line 51, "Pigment,Yellow" should read --Pigment Yellow--.
Line 66, "flowability improving" should read --flowability-improving--.

COLUMN 11:

Line 50, "minimizing" should read --minimize--.
Line 64, "small" should read --smaller--.

COLUMN 12:

Line 34, "may" should read --may be--.
Line 39, "is" should be deleted.
Line 57, "may" should read --may be--.

COLUMN 14:

Line 29, "3aand" should read --3a and--.
Line 49, "5c" should read 5c,--.

COLUMN 19:

Line 26, "on" should read --an--.
Line 44, "on" should read --an--.
Line 63, "on" should read --an--.

UNITED STATES PATENT AND TRADEMARK OFFICE

CERTIFICATE OF CORRECTION

PATENT NO. : 5,842,097

DATED : November 24, 1998

INVENTOR(S) : MAKOTO KANBAYASHI, ET AL.

It is certified that error appears in the above-identified patent and that said Letters Patent is hereby corrected as shown below:

COLUMN 20:

Line 6, "aqent" should read --agent--.
Line 15, "on" should read --an--.
Line 35, "on" should read --an--.
Line 56, "on" should read --an--.

COLUMN 21:

Line 11, "on" should read --an--.
Line 32, "on" should read --an--.
Line 54, "on" should read --an--.

COLUMN 23:

Line 29, "paticle" should read --particle--.

COLUMN 25:

Line 54, "Polyeser" should read --Polyester--.
Line 55, "Polyeser" should read --Polyester--.
Line 67, "7001"," should read --700",--.

COLUMN 26:

Line 11, "an" should read --and--.

UNITED STATES PATENT AND TRADEMARK OFFICE

CERTIFICATE OF CORRECTION

PATENT NO. : 5,842,097

DATED : November 24, 1998

INVENTOR(S) : MAKOTO KANBAYASHI, ET AL.

It is certified that error appears in the above-identified patent and that said Letters Patent is hereby corrected as shown below:

COLUMN 28:

Line 64, "used." should read --level.--.

COLUMN 29:

Line 9, "used." should read --level.--.
Line 20, "lowered" should read --lower--.
Line 24, "used." should read --level.--.
Line 39, "used." should read --level.--.

Signed and Sealed this

Fourth Day of January, 2000

*Attest:*

*Attesting Officer*

*Acting Commissioner of Patents and Trademarks*